US009059509B2

(12) United States Patent
Chen et al.

(10) Patent No.: US 9,059,509 B2
(45) Date of Patent: Jun. 16, 2015

(54) DECOUPLING CIRCUIT AND ANTENNA DEVICE

(75) Inventors: I-Shan Chen, Hsinchu (TW); Tien-Min Lin, Hsinchu (TW); Cheng-Hsiung Hsu, Hsinchu (TW); Yi-Chieh Wang, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 340 days.

(21) Appl. No.: 13/603,438

(22) Filed: Sep. 5, 2012

(65) Prior Publication Data

US 2013/0335286 A1 Dec. 19, 2013

(30) Foreign Application Priority Data

Jun. 18, 2012 (TW) ..... 101121721 A

(51) Int. Cl.
*H01Q 1/52* (2006.01)
*H01Q 9/30* (2006.01)

(52) U.S. Cl.
CPC . *H01Q 9/30* (2013.01); *H01Q 1/521* (2013.01)

(58) Field of Classification Search
CPC ..... H01Q 1/521; H01Q 1/52; H01Q 1/523; H01Q 1/525; H01Q 1/24; H01Q 1/241; H01Q 1/242; H01Q 1/243; H01Q 1/245; H01Q 1/36; H01Q 1/38; H01Q 1/282; H01Q 1/283; H01Q 1/32; H01Q 1/325; H01Q 1/3275; H01Q 1/3283; H01Q 1/1271; H01Q 9/30; H01Q 9/32; H01Q 9/40; H01Q 9/42
USPC ..... 343/841, 834, 835, 837, 702, 844, 893, 343/700 MS, 711, 713
See application file for complete search history.

(56) References Cited

U.S. PATENT DOCUMENTS

| | | | | |
|---|---|---|---|---|
| 6,025,812 | A * | 2/2000 | Gabriel et al. | 343/797 |
| 6,356,242 | B1 * | 3/2002 | Ploussios | 343/795 |
| 7,916,089 | B2 * | 3/2011 | Schlub et al. | 343/702 |
| 2011/0175749 | A1 | 7/2011 | Ellsworth, III | |

FOREIGN PATENT DOCUMENTS

| | | | |
|---|---|---|---|
| CN | 201549580 | U | 8/2010 |
| CN | 101872897 | A | 10/2010 |
| CN | 201893439 | U | 7/2011 |

* cited by examiner

*Primary Examiner* — Hoang V Nguyen
*Assistant Examiner* — Patrick Holecek
(74) *Attorney, Agent, or Firm* — Winston Hsu; Scott Margo

(57) ABSTRACT

A decoupling circuit for enhancing isolation of two monopole antennas is disclosed. The two monopole antennas substantially symmetrically stand on a bottom, and a gap is formed between the two monopole antennas. The decoupling circuit includes a grounding element located on the bottom and electrically connected to a ground, a connection bar substantially perpendicular to the bottom, including a first terminal electrically connected to the grounding element, a second terminal extending to the gap, a first branch extending from the second terminal of the connection bar to a first monopole antenna of the two monopole antennas, and a second branch extending from the second terminal of the connection bar to a second monopole antenna of the two monopole antennas.

18 Claims, 11 Drawing Sheets

DECOUPLING CIRCUIT AND ANTENNA DEVICE

BACKGROUND OF THE INVENTION

1. Field of the Invention

The present invention relates to a decoupling circuit and an antenna device, and more particularly, to a decoupling circuit and an antenna device capable of enhancing isolation of monopole antennas effectively and contributing full use of three-dimensional space.

2. Description of the Prior Art

Electronic products with wireless communication functionalities utilize antennas to emit and receive radio waves, to transmit or exchange radio signals, so as to access a wireless communication network. Therefore, to facilitate a user's access to the wireless communication network, an ideal antenna should maximize its bandwidth within a permitted range, while minimizing physical dimensions to accommodate the trend for smaller-sized electronic products. Additionally, with the advance of wireless communication technology, electronic products may be configured with an increasing number of antennas. For example, a long term evolution (LTE) wireless communication system and a wireless local area network standard IEEE 802.11n both support multi-input multi-output (MIMO) technology, i.e. an electronic product is capable of concurrently receiving and transmitting wireless signals via multiple (or multiple sets of) antennas, to vastly increase system throughput and transmission distance without increasing system bandwidth or total transmission power expenditure, thereby effectively enhancing spectral efficiency and transmission rate for the wireless communication system, as well as improving communication quality.

As can be seen, a prerequisite for implementing spatial multiplexing and spatial diversity in MIMO is to employ multiple sets of antenna to divide a space into many channels, in order to provide multiple antenna field patterns. When an electronic product is configured with multiple sets of antenna under a limited space, a basic requirement includes that these antennas are independent, do not affect each other, and have good isolation. Therefore, how to reduce mutual coupling between antennas becomes one of the industry goals. However, in the limited space, to enhance the isolation of the antennas and simultaneously maintain throughput of MIMO must increase design complexity. Therefore, it is a common goal in the industry to design antennas that suit both transmission demands, as well as dimension and functionality requirements.

SUMMARY OF THE INVENTION

It is therefore an objective of the invention to provide a decoupling circuit and an antenna device capable of decreasing the mutual coupling between antennas to improve the antenna efficiency.

The present invention discloses a decoupling circuit, for enhancing isolation of two monopole antennas, wherein the two monopole antennas substantially symmetrically stand on a bottom and a gap is formed between the two monopole antennas. The decoupling circuit comprises a grounding element, located on the bottom and electrically connected to a ground terminal, a connection bar, substantially perpendicular to the bottom, comprising a first terminal electrically connected to the grounding element and a second terminal extending to the gap, a first branch, extending from the second terminal of the connection bar to a first monopole antenna of the two monopole antennas, and a second branch, extending from the second terminal of the connection bar to a second monopole antenna of the two monopole antennas.

The present invention further discloses an antenna device, comprising a bottom, with a projection plane perpendicular to the bottom, two monopole antennas, substantially symmetrically standing on the bottom, with a gap formed between the two monopole antennas, wherein projections of the two monopole antennas onto the projection plan are interlaced and each monopole antenna comprises a first frequency receiving element, located on the monopole antenna and near the bottom, a second frequency receiving element, and a connection element, located between the first frequency receiving element and the second frequency receiving element, with a slot formed for adjusting a receiving frequency of the first frequency receiving element or the second frequency receiving element, and a decoupling circuit, for enhancing isolation of the two monopole antennas, comprising a grounding element, located on the bottom and electrically connected to a ground terminal, a connection bar, substantially perpendicular to the bottom, comprising a first terminal electrically connected to the grounding element and a second terminal extending to the gap, a first branch, extending from the second terminal of the connection bar to a first monopole antenna of the two monopole antennas, and a second branch, extending from the second terminal of the connection bar to a second monopole antenna of the two monopole antennas.

The present invention further discloses a decoupling circuit, for enhancing isolation of four monopole antennas, wherein a first monopole antenna and a second monopole antenna of the four monopole antennas substantially symmetrically stand on a bottom and a first gap is formed between the first monopole antenna and the second monopole antenna, a third monopole antenna and a forth monopole antenna of the four monopole antennas substantially symmetrically stand on the bottom and a second gap is formed between the third monopole antenna and the forth monopole antenna, the first monopole antenna and the third monopole antenna are juxtaposed, a third gap is formed between the first monopole antenna and the third monopole antenna, the second monopole antenna and the forth monopole antenna are juxtaposed, and a forth gap is formed between the second monopole antenna and the forth monopole antenna, the decoupling circuit comprising a grounding element, located on the bottom and electrically connected to a ground terminal, a connection bar, substantially perpendicular to the bottom, comprising a first terminal electrically connected to the grounding element and a second terminal extending to a conjunction of the first gap, the second gap, the third gap, and the forth gap, a first branch, extending from the second terminal of the connection bar to the third gap, a second branch, extending from the second terminal of the connection bar to the forth gap, a third branch, extending from a conjunction of the first terminal and the second terminal of the connection bar to the first gap, and a forth branch, extending between the first terminal and the second terminal of the connection bar to the second gap.

The present invention further discloses an antenna device, comprising a bottom, with a projection plane perpendicular to the bottom, four monopole antennas, wherein a first monopole antenna and a second monopole antenna of the four monopole antennas substantially symmetrically stand on a bottom and a first gap is formed between the first monopole antenna and the second monopole antenna, a third monopole antenna and a forth monopole antenna of the four monopole antennas substantially symmetrically stand on a bottom and a second gap is formed between the third monopole antenna and the forth monopole antenna, the first monopole antenna and the third monopole antenna are juxtaposed, a third gap is formed between the first monopole antenna and the third monopole antenna, the second monopole antenna and the forth monopole antenna are juxtaposed, a forth gap is formed between the second monopole antenna and the forth monopole antenna, and each monopole antenna comprises a first frequency receiving element, located on the monopole antenna and near the bottom, a second frequency receiving element, and a connection element, located between the first frequency receiving element and the second frequency receiving element, with a slot formed for adjusting a receiving frequency of the first frequency receiving element or the second frequency receiving element, and a decoupling circuit, for enhancing isolation of the four monopole antennas, comprising a grounding element, located on the bottom and electrically connected to a ground terminal, a connection bar, substantially perpendicular to the bottom, comprising a first terminal electrically connected to the grounding element and a second terminal extending to a gap formed between the first gap, the second gap, the third gap, and the forth gap, a first branch, extending from the second terminal of the connection bar to the third gap, a second branch, extending from the second terminal of the connection bar to the forth gap, a third branch, extending from a conjunction of the first terminal and the second terminal of the connection bar to the first gap, and a forth branch, extending from a conjunction of the first terminal and the second terminal of the connection bar to the second gap.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
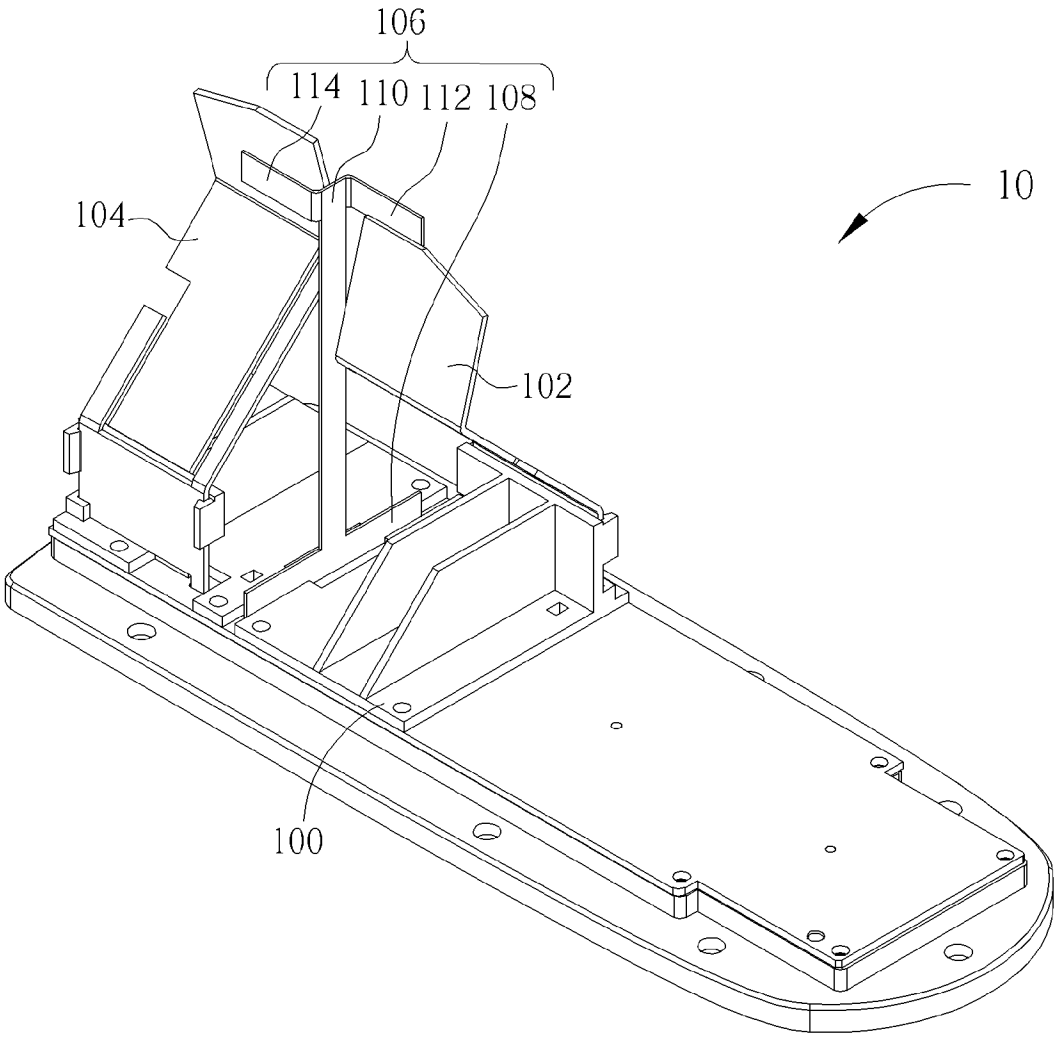
FIG. 1A illustrates a three-dimensional diagram of an antenna device according to an embodiment of the present invention.

Please refer to FIG. 1A, which illustrates a three-dimensional diagram of an antenna device 10 according to an embodiment of the present invention. The antenna device 10 comprises a bottom 100, a first monopole antenna 102, a second monopole antenna 104, and a decoupling circuit 106. Detailed operations, structures, alterations, and etc. of the bottom 100, the first monopole antenna 102 and the second monopole antenna 104 can refer to the antenna device disclosed in U.S. patent application Ser. No. 13/440,189 and will not be narrated hereinafter. The difference between the antenna device 10 in FIG. 1A and the antenna device disclosed in U.S. patent application Ser. No. 13/440,189 is that, in FIG. 1A, the antenna device 10 utilizes the decoupling circuit 106 to enhance isolation of the first monopole antenna 102 and the second monopole antenna 104, so as to maintain or increase throughput of MIMO. Meanwhile, the transverse area of the decoupling circuit 106 is not significantly increased and will not occupy antenna area, which contributes efficient use of three-dimensional space, maintains radiation patterns of the original antenna structure, and improves the antenna efficiency.

Figure 1B:
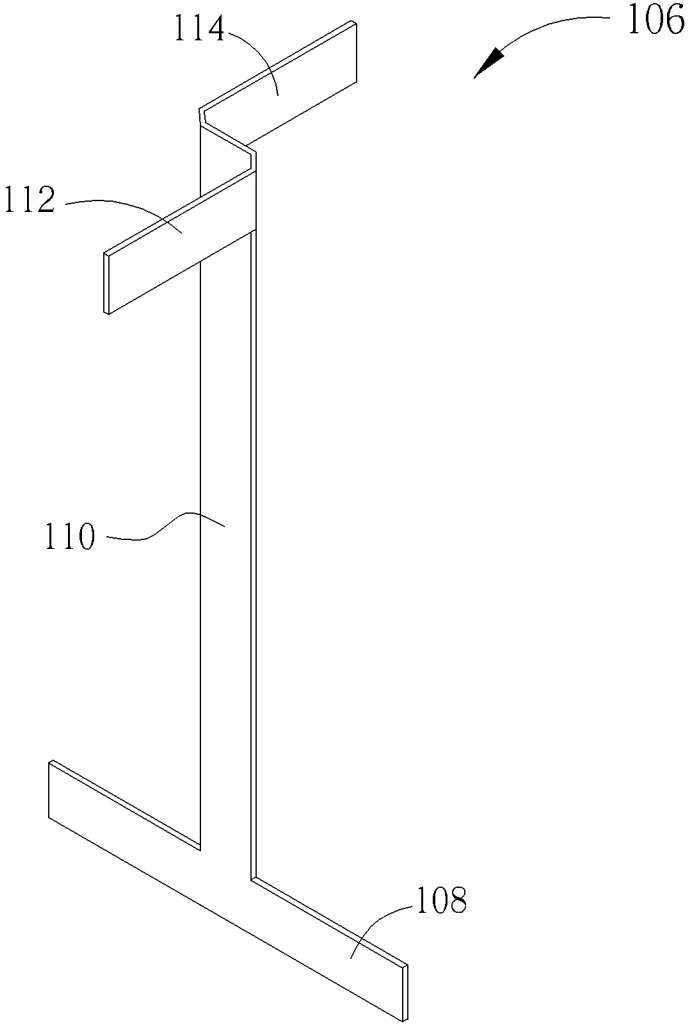
FIG. 1B illustrates a schematic diagram of a detailed structure of a decoupling circuit in FIG. 1A.

In detail, please refer to FIG. 1B, which illustrates a schematic diagram of the structure of the decoupling circuit 106. The decoupling circuit 106 includes a grounding element 108, a connection bar 110, a first branch 112, and a second branch 114. The grounding element 108 is located on the bottom 100 and electrically connected to a ground terminal. The connection bar 110 is substantially perpendicular to the bottom 100. A terminal of the connection bar 110 is electrically connected to the grounding element 108, and another terminal of the connection bar 110 extends toward a gap between the first monopole antenna 102 and the second monopole antenna 104, and stretches out the first branch 112 toward the first monopole antenna 102 and the second branch 104 toward the second monopole antenna 104. Besides, as shown in FIG. 1A and FIG. 1B, the first branch 112 and second branch 114 are not located on the same plane. The distance between located planes of the first branch 112 and the second branch 114 is a width of the connection bar 110. However, the configuration that the first branch 112 and second branch 114 are located on different planes is based on space utilization and is not limited herein. In other embodiments, the first branch 112 and the second branch 114 can also be located on the same plane.

Moreover, in the antenna device 10, the first monopole antenna 102 and the second monopole antenna 104 are substantially symmetrical and stand on the bottom 100 for transmitting or receiving wireless signals of the same frequency band. A length of the first branch 112 is substantially equal to a length of the second branch 114, and a total length of the connection bar 110 and the first branch 112 or a total length of the connection bar 110 and the second branch 114 is substantially equal to a quarter wavelength of wireless signals to be transmitted or received by the first monopole antenna 102 and the second monopole antenna 104, so as to generate the decoupling effect to the first monopole antenna 102 and the second monopole antenna 104. According to the electromagnetic theory, a quarter wavelength of a wireless signal is the basic requirement to generate electromagnetic induction. Therefore, the total length of the connection bar 110 and the first branch 112 or the total length of the connection bar 110 and the second branch 114 is not limited to a quarter wavelength of the wireless signals, and can be substantially equal to multiple integer times of a quarter wavelength of the wireless signal, which can also generate the decoupling effect to the first monopole antenna 102 and the second monopole antenna 104. In addition to the length of the decoupling circuit 106, the metal widths of the connection bar 110, the first branch 112 and the second branch 114, the distance from the decoupling circuit 106 to the first monopole antenna 102, and the distance from the decoupling circuit 106 to the second monopole antenna 104 may adjust isolation of high and low frequency bands and should be properly configured according to different requirements, to meet the needed isolation, resonance frequency, efficiency and antenna radiation pattern, etc.

Figure 2:
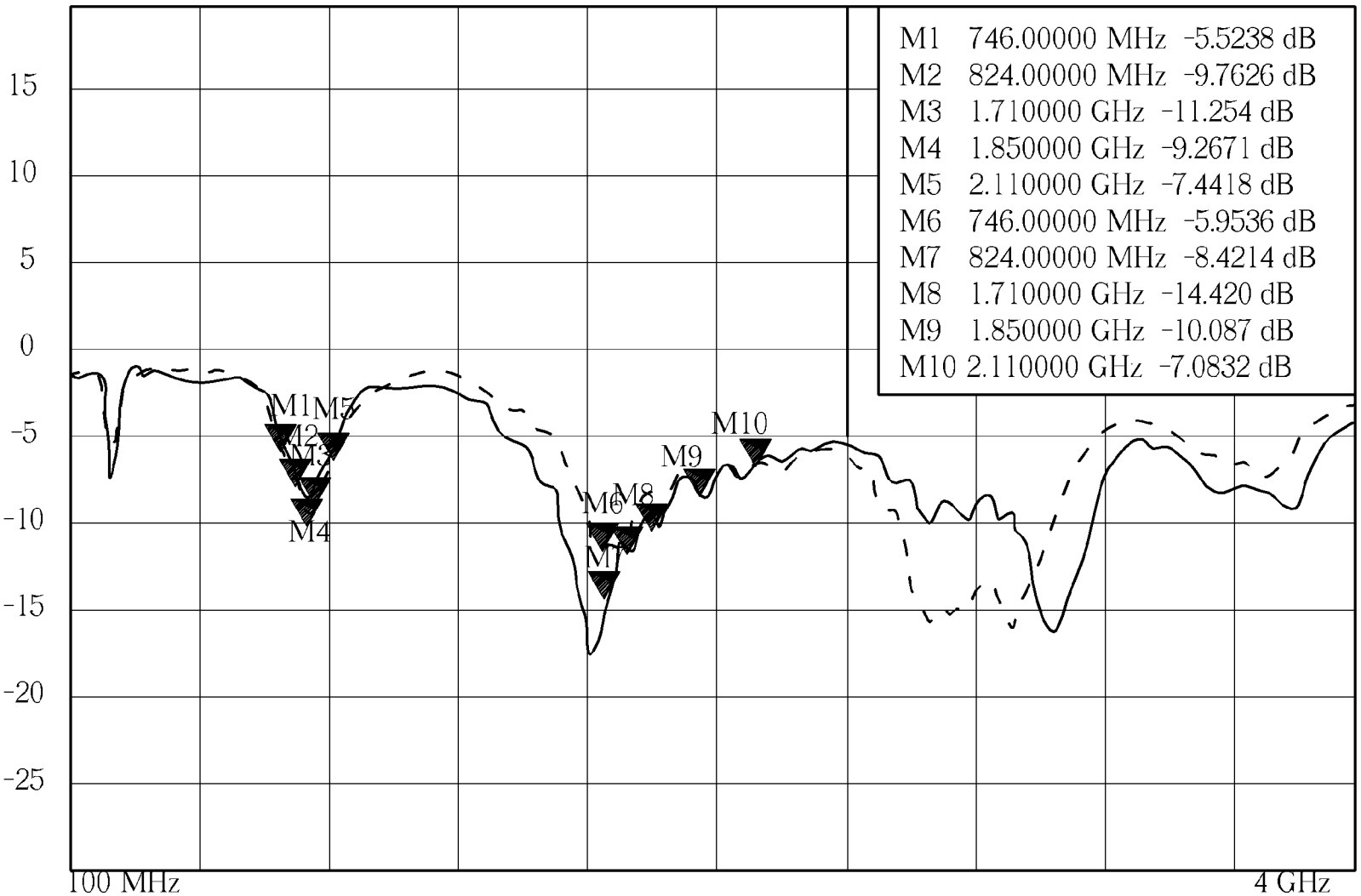
FIG. 2 illustrates a relation between voltage standing wave ratio (VSWR) and corresponding operating frequency of the antenna device with and without a decoupling circuit in FIG. 1A.
Figure 3:
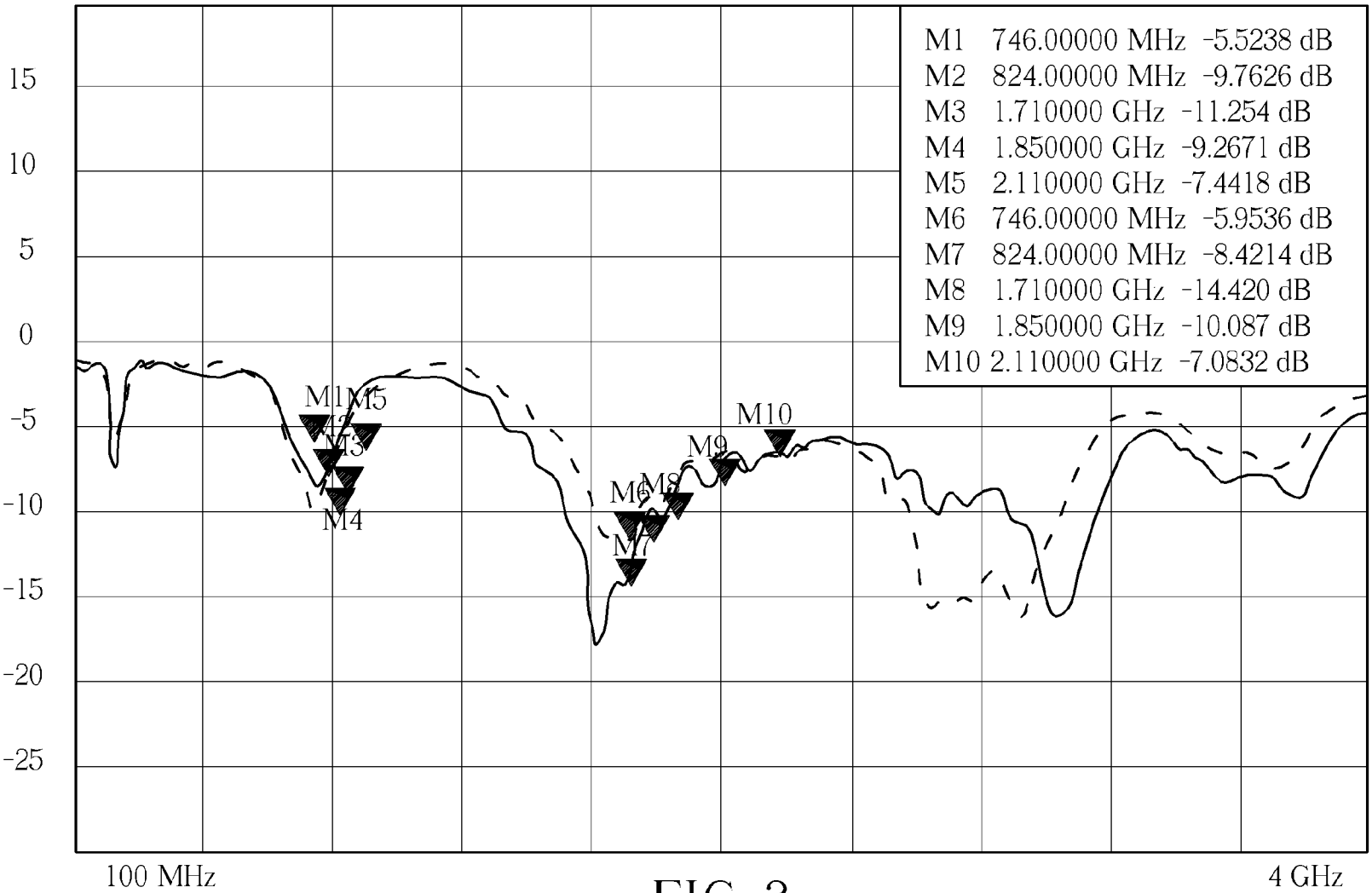
FIG. 3 illustrates a relation between isolation and corresponding frequency of the antenna device with a decoupling circuit in FIG. 1A.
Figure 4A:
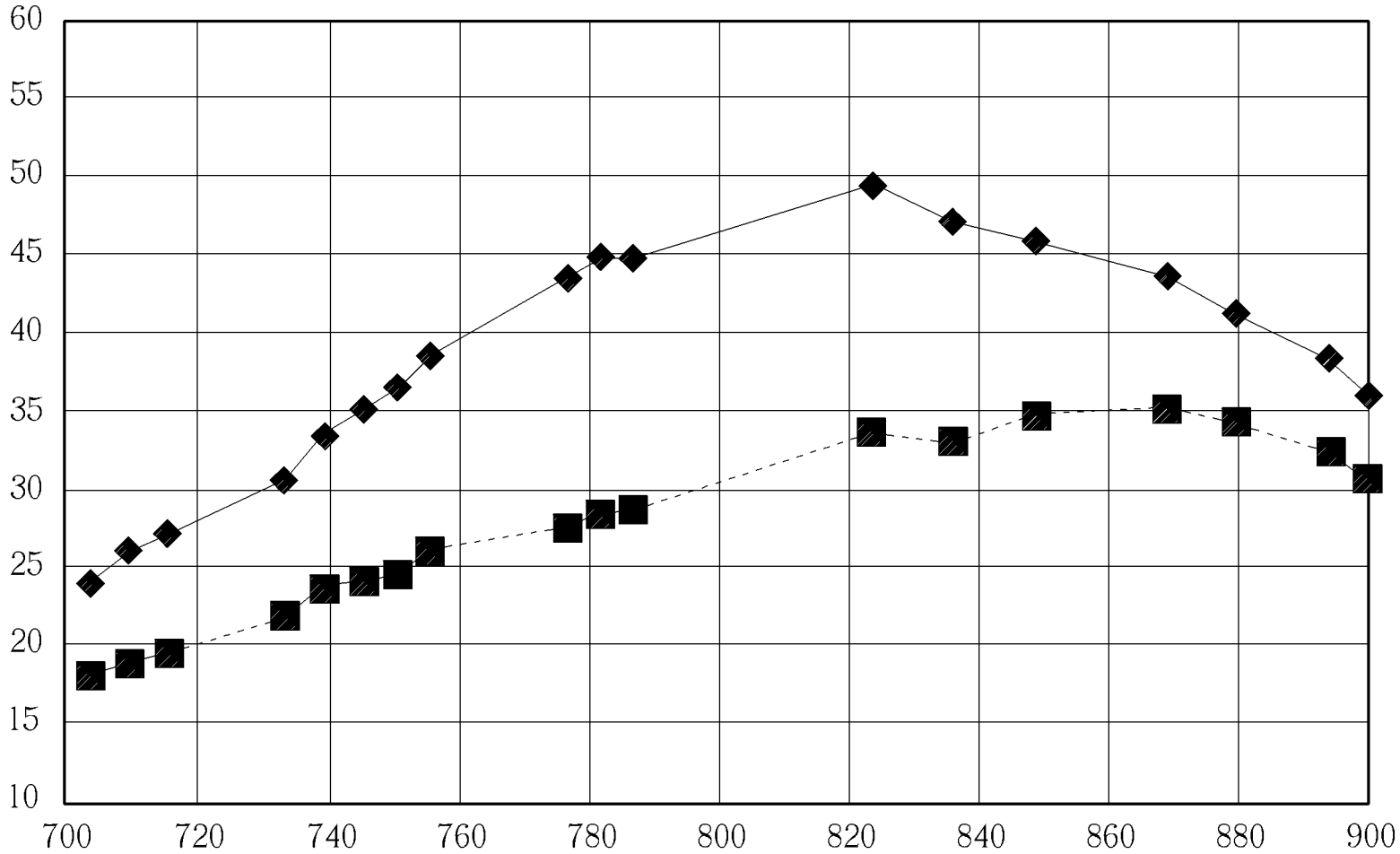
FIG. 4A and FIG. 4B illustrates a relation between radiation efficiency and corresponding low frequency and a relation between radiation efficiency and corresponding high frequency of the antenna device with a decoupling circuit in FIG. 1A.
Figure 4B:
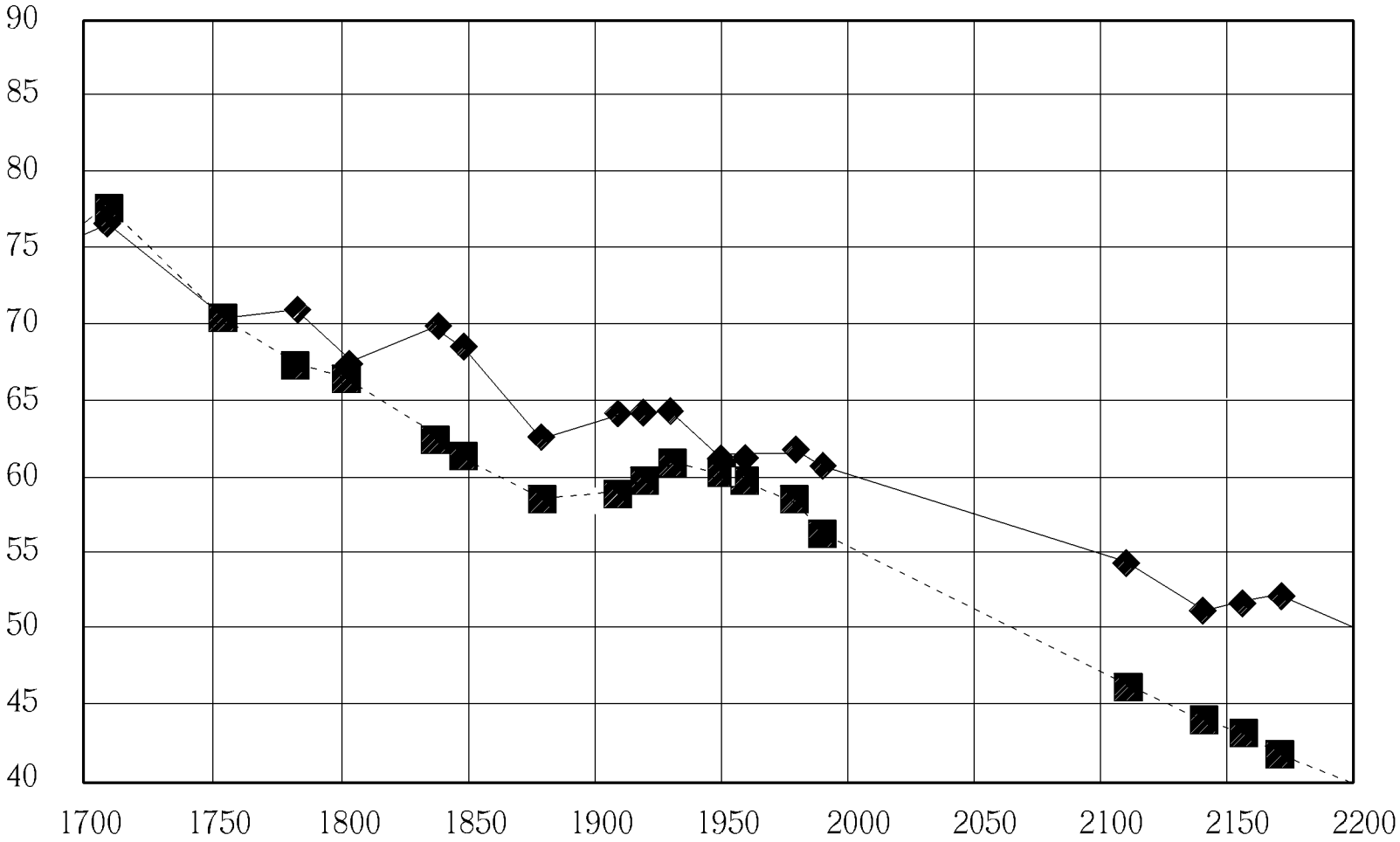
Figure 5A:
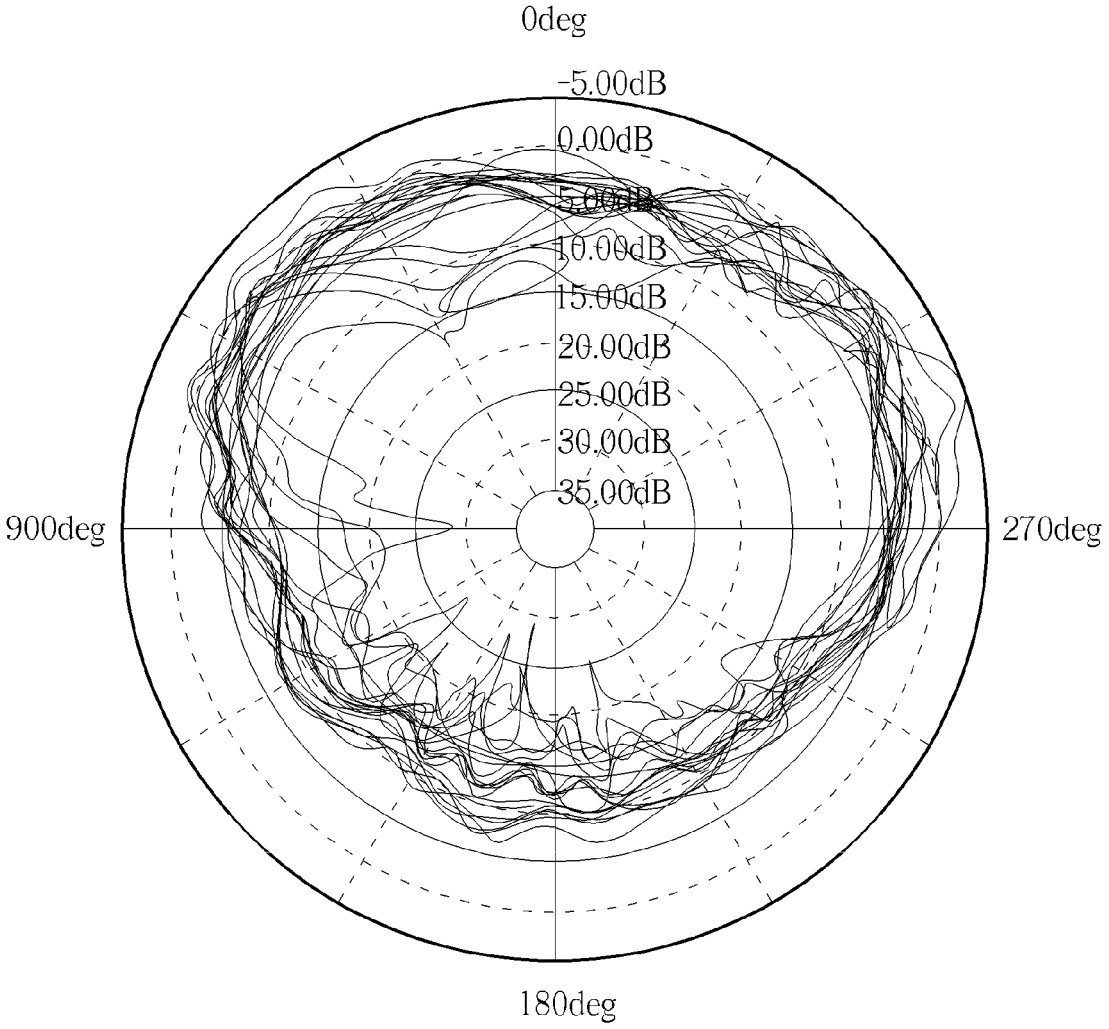
FIG. 5A and FIG. 5B illustrates antenna two-dimensional graphs of the antenna device with a decoupling circuit in FIG. 1A.
Figure 5B:
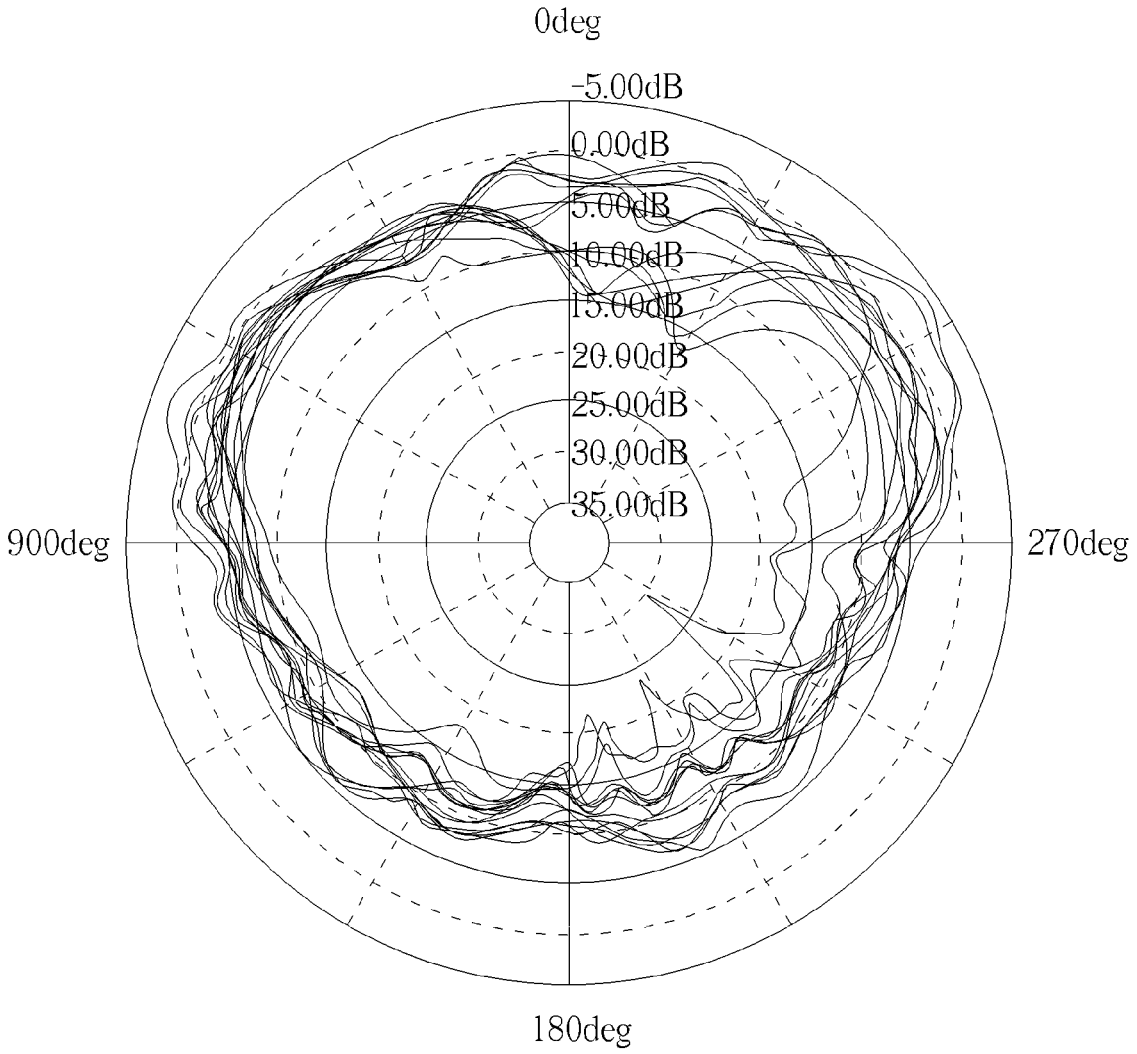

As to the isolation improvement of the decoupling circuit 106, please continue to refer to FIG. 2, FIG. 3, FIG. 4A, FIG. 4B, FIG. 5A and FIG. 5B. FIG. 2 illustrates a schematic diagram of voltage standing wave ratio (VSWR) vs. operating frequency of the antenna device 10 before and after the decoupling circuit 106 is added, wherein a dotted line represents the VSWR before the antenna device 10 equips with the decoupling circuit 106 and a solid line represents the VSWR after the antenna device 10 equips with the decoupling circuit 106. FIG. 3 illustrates a schematic diagram of isolation vs. frequency of the first monopole antenna 102 and the second monopole antenna 104 before and after the decoupling circuit 106 is added, wherein a dotted line represents isolation before the antenna device 10 equips with the decoupling circuit 106 and a solid line represents isolation after the antenna device 10 equips with the decoupling circuit 106. As shown in FIG. 3, the isolation of the first monopole antenna 102 and the second monopole antenna 104 is improved at least from 2 dB to 3 dB after the decoupling circuit 106 is added. Next, FIG. 4A and FIG. 4B illustrate schematic diagrams of radiating efficiency corresponding to low frequency band and high frequency band of the first monopole antenna 102 and the second monopole antenna 104 after the antenna device 10 equips with the decoupling circuit 106, wherein a solid line represents efficiency of a main antenna within the first monopole antenna 102 and the second monopole antenna 104 and a dashed line represents efficiency of a secondary antenna within the first monopole antenna 102 and the second monopole antenna 104. As can be seen from FIG. 4A and FIG. 4B, the main antenna efficiency still maintains at 35%-80%. Finally, FIG. 5A and FIG. 5B illustrates two-dimensional electric field radiation pattern graphs (E-plan) corresponding to operating frequency of the first monopole antenna 102 and the second monopole antenna 104 after the antenna device 10 equips with the decoupling circuit 106.

Therefore, as can be seen from FIG. 2 to FIG. 5A and FIG. 5B, after the antenna device 10 equips with the decoupling circuit 106, the isolation of the first monopole antenna 102 and the second monopole antenna 104 can be effectively improved, and radiating efficiencies of high and low frequency are maintained. Thereby, for applications of MIMO, the antenna device 10 equipping with the decoupling circuit 106 can reduce mutual coupling between antennas and increase throughput of MIMO.

Note that, the decoupling circuit 106 shown in FIG. 1A and FIG. 1B is an embodiment of the present invention, and those skilled in the art can make modifications accordingly. For example, the decoupling circuit 106 can be made by a one-piece metal sheet to reduce the cost of materials. Besides, manufacturers can adopt methods of coating, printing, laser direct structuring (LDS), etching or evaporating to form the conductive coating on a surface of a metal sheet or directly coat with paint or plastic on the surface of the metal sheet to perform isolation from contacts. Additionally, please refer to FIG. 6, which illustrates a schematic diagram of a decoupling circuit 60 according to an embodiment of the present invention. The decoupling circuit 60 is derived from the decoupling circuit 106 and utilizes the same symbols to represent the same components in the decoupling circuit 106. The difference between the decoupling circuit 60 and the decoupling circuit 106 is that a third branch 116 and a forth branch 118 are added in the decoupling circuit 60. The third branch 116 and the forth branch 118 respectively extend from a middle of the connection bar 110 to the first monopole antenna 102 and to the second monopole antenna 104, which can further enhance the decoupling effect and improve isolation of antennas to maintain or increase throughput of MIMO.

Figure 6:
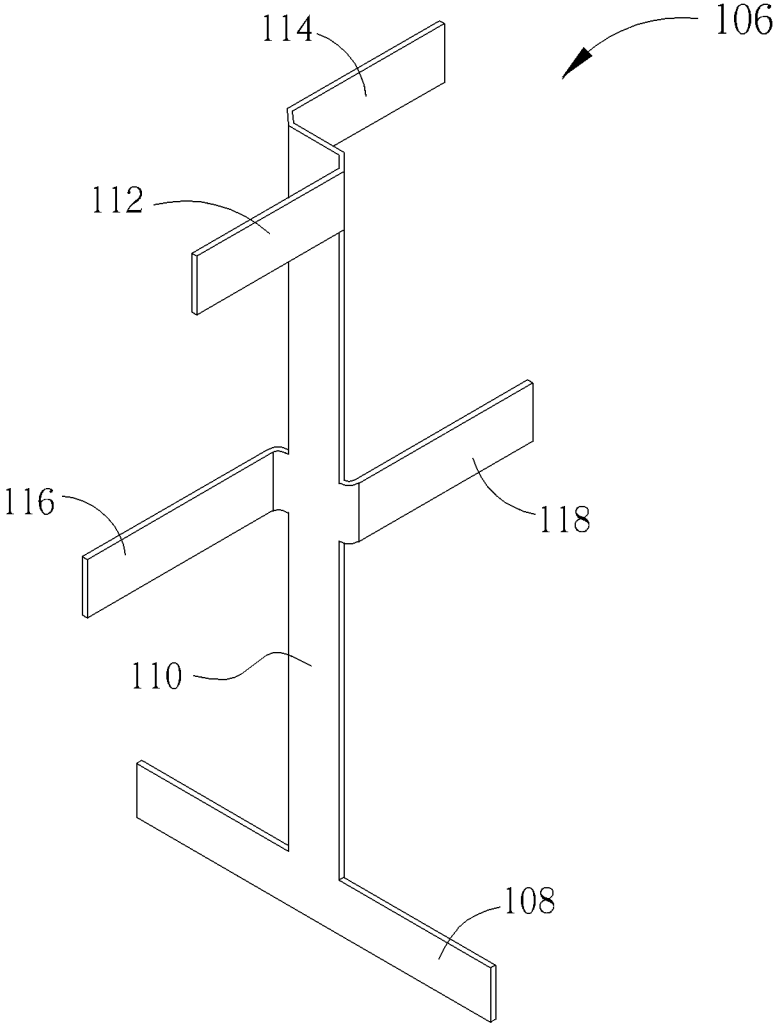
FIG. 6 illustrates a schematic diagram of a decoupling circuit according to an embodiment of the present invention.

Besides, as shown in FIG. 6, the third branch 116 and the second branch 114 are located on the same plane, and the forth branch 118 and the first branch 112 are located on the same plane. Such a configuration is based on space utilization and is not limited herein and can also be properly configured according to system requirements.

The above embodiments aim at enhancing the isolation of two monopole antennas, and by the same token, the decoupling circuit of more than two monopole antennas can also be derived. For example, please refer to FIG. 7A, which illustrates a three-dimensional diagram of an antenna device 70 according to an embodiment of the present invention. The antenna device 70 includes a bottom 700, a first monopole antenna 702, a second monopole antenna 704, a third monopole antenna 706, a forth monopole antenna 708, and a decoupling circuit 710. The first monopole antenna 702, the second monopole antenna 704, the third monopole antenna 706, and the forth monopole antenna 708 can be regarded as a result of repeatedly juxtaposing the first monopole antenna 102 and the second monopole antenna 104 shown in FIG. 1A by two arrangement ways. Therefore, detailed operating principles, structures, and alterations, etc. can refer to the above descriptions and the antenna device disclosed in U.S. patent application Ser. No. 13/440,189, and will not be narrated hereinafter. The decoupling circuit 710 is located among the first monopole antenna 702, the second monopole antenna 704, the third monopole antenna 706, and the forth monopole antenna 708, and is utilized for enhancing isolation to maintain or increase throughput of MIMO. Meanwhile, the transverse area of the decoupling circuit 710 is not significantly increased and will not occupy antenna area, which contributes efficient use of three-dimensional space, maintains radiation patterns of the original antenna structure, and improves the antenna efficiency.

Figure 7A:
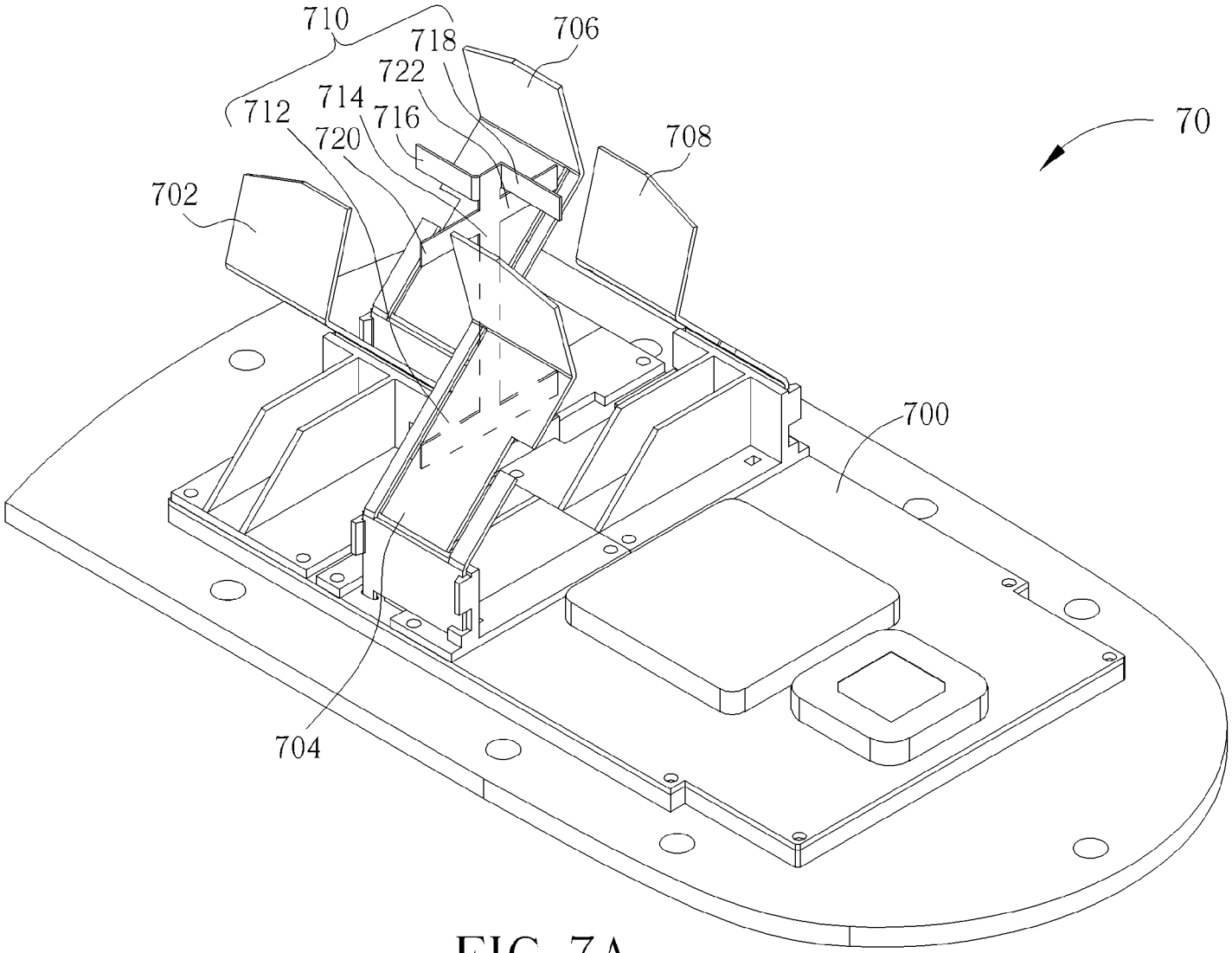
FIG. 7A illustrates a three-dimensional diagram of an antenna device according to an embodiment of the present invention.
Figure 7B:
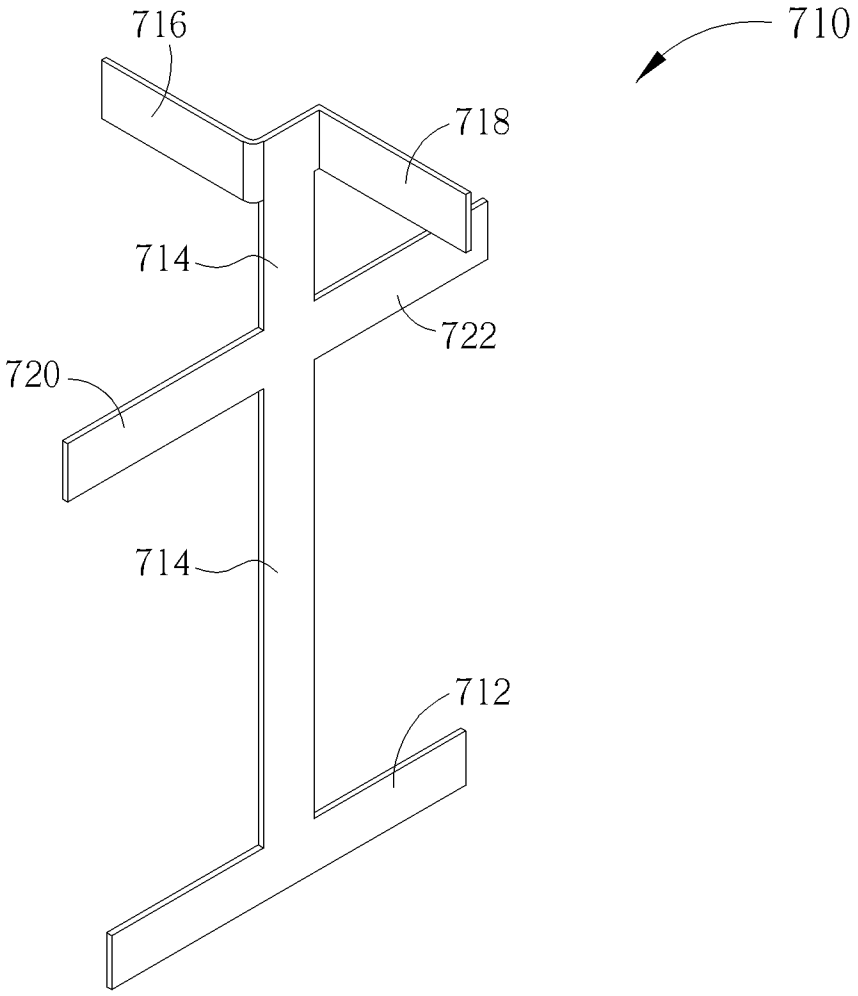
FIG. 7B illustrates a schematic diagram of a detailed structure of a decoupling circuit in FIG. 7A.

In detail, please refer to FIG. 7B, which illustrates a schematic diagram of the structure of the decoupling circuit 710. The decoupling circuit 710 includes a grounding element 712, a connection bar 714, a first branch 716, a second branch 718, a third branch 720 and a forth branch 722. The grounding element 712 is located on the bottom 700 and electrically connected to a ground terminal. The connection bar 714 is substantially perpendicular to the bottom 700. A terminal of the connection bar 714 is electrically connected to the grounding element 700; another terminal of the connection bar 714 extends toward a central gap between the four monopole antennas, and stretches out the first branch 716 toward a gap between the first monopole antenna 702 and the third monopole antenna 706, stretches out the second branch 718 toward a gap between the second monopole antenna 704 and the forth monopole antenna 708, stretches out the third branch 720 toward a gap between the first monopole antenna 702 and the second monopole antenna 704, and stretches out the forth branch 722 toward a gap between the third monopole antenna 706 and the forth monopole antenna 708. Besides, as shown in FIG. 7A and FIG. 7B, the first branch 716 and the second branch 718 are not located on the same plane. The distance between located planes of the first branch 716 and the second branch 718 is a width of the connection bar 714. However, the configuration that the first branch 716 and the second branch 718 are located on different planes is based on space utilization and is not limited herein. In other embodiments, the first branch 716 and the second branch 718 can also be located on the same plane. Similarly, the third branch 720 and the forth branch 722 are located on the same plane in this embodiment and are not limited herein, and can also be properly configured according to space utilization.

Moreover, in the antenna device 70, the first monopole antenna 702 and the second monopole antenna 704 are substantially symmetrical and stand on the bottom 700, and the third monopole antenna 706 and the forth monopole antenna 708 are substantially symmetrical and stand on the bottom 700, so as to transmit or receive wireless signals of the same frequency band. Lengths of the first branch 716, the second branch 718, the third branch 720 and the forth branch 722 are substantially identical, and a total length of the connection bar 714 and any one of the four branches is substantially equal to one or multiple integer times of a quarter wavelength of the wireless signals to be transmitted or received by the four monopole antennas, so as to generate the decoupling effect to the four monopole antennas. Beside, the length and the metal width of the decoupling circuit 710, and the distances from the decoupling circuit 710 to the four monopole antennas may affect isolation of high and low frequency bands and should be properly configured according to different requirements to meet the needed isolation, resonance frequency, efficiency, antenna radiation pattern, etc.

Note that, the above embodiments are based upon the antenna device disclosed in U.S. patent application Ser. No. 13/440,189 and are not limited herein. The decoupling circuits of the present invention are adapted to applications of multiple monopole antennas, to enhance isolation thereof, as long as the dimension of the decoupling circuit, the distances from the decoupling circuit to the monopole antennas, the material of the decoupling circuit, the shape of the decoupling circuit, etc. are properly configured according to the frequency of wireless signals to be received, the antenna efficiency, field type, the isolation status, etc., so as to maintain or increase throughput of MIMO. In addition, the antenna devices 10 and 70 shown in FIGS. 1A and 7A exclude elements of a cover, a support plate, etc. for simplicity and can also be properly configured according to the antenna device disclosed in U.S. patent application Ser. No. 13/440,189.

In summary, the decoupling circuit of the present invention can effectively enhance isolation of monopole antennas, so as to maintain or increase throughput of MIMO. Meanwhile, the decoupling circuit of the present invention does not significantly increase the transverse area and will not occupy antenna area, which contributes efficient use of three-dimensional space, maintains radiation patterns of the original antenna structure, and improves the antenna efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A decoupling circuit, for enhancing isolation of two monopole antennas, wherein the two monopole antennas substantially symmetrically stand on a bottom and a gap is formed between the two monopole antennas, the decoupling circuit comprising:

a grounding element, located on the bottom and electrically connected to a ground terminal;

a connection bar, substantially perpendicular to the bottom, comprising a first terminal electrically connected to the grounding element and a second terminal extending to the gap;

a first branch, extending from the second terminal of the connection bar to a first monopole antenna of the two monopole antennas; and a second branch, extending from the second terminal of the connection bar to a second monopole antenna of the two monopole antennas;

wherein vertical projections of the first monopole antenna and the second monopole antenna onto a projection plane perpendicular to the bottom are interlaced.

2. The decoupling circuit of claim 1, wherein the two monopole antennas are respectively utilized for transmitting or receiving wireless signals of a particular frequency band.

3. The decoupling circuit of claim 2, wherein a length of the first branch is substantially equal to a length of the second branch, and a total length of the connection bar and the first branch or a total length of the connection bar and the second branch is substantially equal to a quarter wavelength of the wireless signals.

4. The decoupling circuit of claim 1, further comprising:

a third branch, extending from a conjunction of the first terminal and the second terminal of the connection bar to the first monopole antenna; and a forth branch, extending from a conjunction of the first terminal and the second terminal of the connection bar to the second monopole antenna.

5. The decoupling circuit of claim 1, being made of conductive material.

6. The decoupling circuit of claim 1, wherein vertical projections of the first monopole antenna and the first branch onto the bottom are overlapped, and vertical projections of the second monopole antenna and the second branch onto the bottom are overlapped.

7. An antenna device, comprising:

a bottom, with a projection plane perpendicular to the bottom;

two monopole antennas, substantially symmetrically standing on the bottom, with a gap formed between the two monopole antennas, wherein vertical projections of the two monopole antennas onto the projection plane are interlaced and each monopole antenna comprises:

a first frequency receiving element, located on the monopole antenna and near the bottom;

a second frequency receiving element; and a connection element, located between the first frequency receiving element and the second frequency receiving element, with a slot formed for adjusting a receiving frequency of the first frequency receiving element or the second frequency receiving element; and a decoupling circuit, for enhancing isolation of the two monopole antennas, comprising:

a grounding element, located on the bottom and electrically connected to a ground terminal;

a connection bar, substantially perpendicular to the bottom, comprising a first terminal electrically connected to the grounding element and a second terminal extending to the gap;

a first branch, extending from the second terminal of the connection bar to a first monopole antenna of the two monopole antennas; and a second branch, extending from the second terminal of the connection bar to a second monopole antenna of the two monopole antennas.

8. The antenna device of claim 7, wherein the two monopole antennas are respectively utilized for transmitting or receiving wireless signals of a particular frequency band.

9. The antenna device of claim 8, wherein a length of the first branch is substantially equal to a length of the second branch, and a total length of the connection bar and the first branch or a total length of the connection bar and the second branch is substantially equal to a quarter wavelength of the wireless signals.

10. The antenna device of claim 7, further comprising:

a third branch, extending from a conjunction of the first terminal and the second terminal of the connection bar to the first monopole antenna; and a forth branch, extending from a conjunction of the first terminal and the second terminal of the connection bar to the second monopole antenna.

11. The antenna device of claim 7, being made of conductive material.

12. The antenna device of claim 7, wherein vertical projections of the first monopole antenna and the first branch onto the bottom are overlapped, and vertical projections of the second monopole antenna and the second branch onto the bottom are overlapped.

13. A decoupling circuit, for enhancing isolation of four monopole antennas, wherein a first monopole antenna and a second monopole antenna of the four monopole antennas substantially symmetrically stand on a bottom and a first gap is formed between the first monopole antenna and the second monopole antenna, a third monopole antenna and a fourth monopole antenna of the four monopole antennas substantially symmetrically stand on the bottom and a second gap is formed between the third monopole antenna and the fourth monopole antenna, the first monopole antenna and the third monopole antenna are juxtaposed, a third gap is formed between the first monopole antenna and the third monopole antenna, the second monopole antenna and the fourth monopole antenna are juxtaposed, and a fourth gap is formed between the second monopole antenna and the fourth monopole antenna, the decoupling circuit comprising:

a grounding element, located on the bottom and electrically connected to a ground terminal;

a connection bar, substantially perpendicular to the bottom, comprising a first terminal electrically connected to the grounding element and a second terminal extending to a conjunction of the first gap, the second gap, the third gap, and the fourth gap;

a first branch, extending from the second terminal of the connection bar to the third gap;

a second branch, extending from the second terminal of the connection bar to the fourth gap;

a third branch, extending from a conjunction of the first terminal and the second terminal of the connection bar to the first gap; and a fourth branch, extending from a conjunction of the first terminal and the second terminal of the connection bar to the second gap;

wherein vertical projections of the first monopole antenna and the second monopole antenna onto a projection plane perpendicular to the bottom are interlaced, and vertical projections of the third monopole antenna and the fourth monopole antenna onto the projection plane perpendicular to the bottom are interlaced.

14. The decoupling circuit of claim 13, wherein the four monopole antennas are respectively utilized for transmitting or receiving wireless signals of a particular frequency band.

15. The decoupling circuit of claim 14, wherein a length of the first branch, a length of the second branch, a length of the third branch, and a length of the fourth branch substantially equal and a total length of the connection bar and the first branch, a total length of the connection bar and the second branch, a total length of the connection bar and the third branch, or a total length of the connection bar and the fourth branch is substantially equal to a quarter wavelength of the wireless signals.

16. An antenna device, comprising:

a bottom, with a projection plane perpendicular to the bottom;

four monopole antennas, wherein a first monopole antenna and a second monopole antenna of the four monopole antennas substantially symmetrically stand on a bottom and a first gap is formed between the first monopole antenna and the second monopole antenna, a third monopole antenna and a fourth monopole antenna of the four monopole antennas substantially symmetrically stand on a bottom and a second gap is formed between the third monopole antenna and the fourth monopole antenna, the first monopole antenna and the third monopole antenna are juxtaposed, a third gap is formed between the first monopole antenna and the third monopole antenna, the second monopole antenna and the fourth monopole antenna are juxtaposed, a fourth gap is formed between the second monopole antenna and the fourth monopole antenna, and each monopole antenna comprises:

a first frequency receiving element, located on the monopole antenna and near the bottom;

a second frequency receiving element; and a connection element, located between the first frequency receiving element and the second frequency receiving element, with a slot formed for adjusting a receiving frequency of the first frequency receiving element or the second frequency receiving element; and a decoupling circuit, for enhancing isolation of the four monopole antennas, comprising:

a grounding element, located on the bottom and electrically connected to a ground terminal;

a connection bar, substantially perpendicular to the bottom, comprising a first terminal electrically connected to the grounding element and a second terminal extending to a gap formed between the first gap, the second gap, the third gap, and the fourth gap;

a first branch, extending from the second terminal of the connection bar to the third gap;

a second branch, extending from the second terminal of the connection bar to the fourth gap;

a third branch, extending from a conjunction of the first terminal and the second terminal of the connection bar to the first gap; and a fourth branch, extending from a conjunction of the first terminal and the second terminal of the connection bar to the second gap;

wherein vertical projections of the first monopole antenna and the second monopole antenna onto the projection plane perpendicular to the bottom are interlaced, and vertical projections of the third monopole antenna and the fourth monopole antenna onto the projection plane perpendicular to the bottom are interlaced.

17. The antenna device of claim 16, wherein the four monopole antennas are respectively utilized for transmitting or receiving wireless signals of a particular frequency band.

18. The antenna device of claim 17, wherein a length of the first branch, a length of second branch, a length of third branch, and a length of fourth branch substantially equal and a total length of the connection bar and the first branch, a total length of the connection bar and the second branch, a total length of the connection bar and the third branch, or a total length of the connection bar and the fourth branch is substantially equal to a quarter wavelength of the wireless signals.

* * * * *